United States Patent [19]

Kubiatowicz

[11] 4,122,627

[45] Oct. 31, 1978

[54] UNDERWATER TOY OPERATED BY CHEMICALLY PRODUCED GAS BUBBLES

[75] Inventor: James F. Kubiatowicz, Minneapolis, Minn.

[73] Assignee: Custom Concepts, Incorporated, Minneapolis, Minn.

[21] Appl. No.: 772,300

[22] Filed: Feb. 25, 1977

[51] Int. Cl.[2] ..... A63H 23/10

[52] U.S. Cl. ..... 46/92; 46/94; 272/8 N

[58] Field of Search ..... 46/91, 92, 94, 44, 95, 46/96, 123, 124, 129; 119/5; 220/337; 272/8 N, 8 D

[56] References Cited

U.S. PATENT DOCUMENTS

| | | | |
|---|---|---|---|
| 1,007,011 | 10/1911 | Sekikawa | 46/94 X |
| 2,356,926 | 8/1944 | Gits | 220/337 |
| 2,404,558 | 7/1946 | Yellin | 220/337 |
| 2,932,916 | 4/1960 | Strickland | 46/94 X |
| 3,265,388 | 8/1966 | Kane | 119/5 X |

*Primary Examiner*—Louis G. Mancene
*Assistant Examiner*—Mickey Yu
*Attorney, Agent, or Firm*—William L. Huebsch

[57] ABSTRACT

A toy including separable base and central portions defining a cavity therebetween and a cover portion pivotably mounted on the central portion. The cover portion has a concave surface positioned over an aperture communicating with the cavity when the cover portion is in a closed position. When a chemical which will produce gas bubbles in the presence of water is placed in the cavity and the toy is dropped into a container of water, the concave surface will trap gas escaping through the aperture under the cover portion until the buoyancy of the gas moves the cover portion to an open position, allowing the accumulated gas to escape.

9 Claims, 6 Drawing Figures

UNDERWATER TOY OPERATED BY CHEMICALLY PRODUCED GAS BUBBLES

FIELD OF THE INVENTION

This invention relates to toys operated by the release of gas bubbles under water.

SUMMARY OF THE INVENTION

According to the present invention there is provided an inexpensive novelty toy which may be molded in one piece from a polymeric material, separated into three portions, and assembled to provide a toy which, with the addition of a chemical which produces gas when combined with water (e.g. with baking powder) and submersion in water can give the appearance of a sea creature opening and closing his mouth.

The toy comprises a base portion adapted to support the toy on a horizontal surface, and a central portion, which, when the toy is assembled, releasably engages and is supported by the base portion. Mating parts of the base and central portion provide a cavity, and the central portion has a through aperture communicating with the cavity. Also included is a cover portion having a generally concave surface and mounted on the central portion for movement between a closed position with the concave surface over the aperture and positioned so that gas bubbles will be retained under the concave surface, and an open position with the concave surface spaced from the aperture so that gas bubbles can escape from beneath the concave surface. When a chemical that produces gas in the presence of water is placed in the cavity and the toy submersed in water, gas escaping through the aperture will be retained against the concave surface of the cover portion until the buoyancy of the gas moves the cover portion to an open position which allows the gas to escape and the cover to return to its closed position.

BRIEF DESCRIPTION OF THE DRAWING

The present invention will be further explained with reference to the accompanying drawing where like numbers refer to like parts throughout the several views, and wherein.

BRIEF DESCRIPTION OF THE PREFERRED EMBODIMENT

Figure 2:
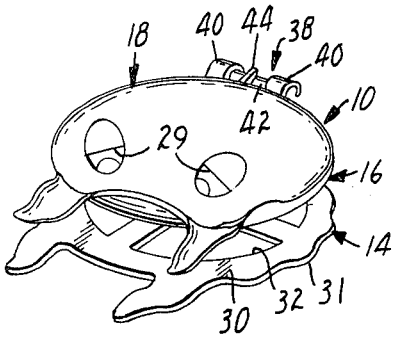
FIG. 2 is a perspective view of the toy of FIG. 1 after assembly thereof.
Figure 3:
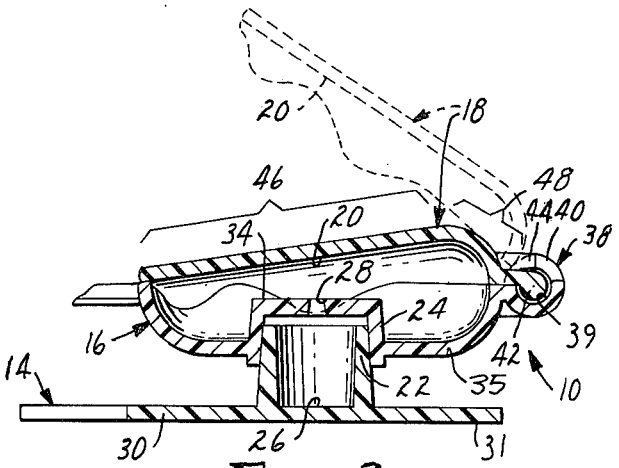
FIG. 3 is an enlarged vertical sectional view of the assembled toy of FIG. 2.
Figure 1:
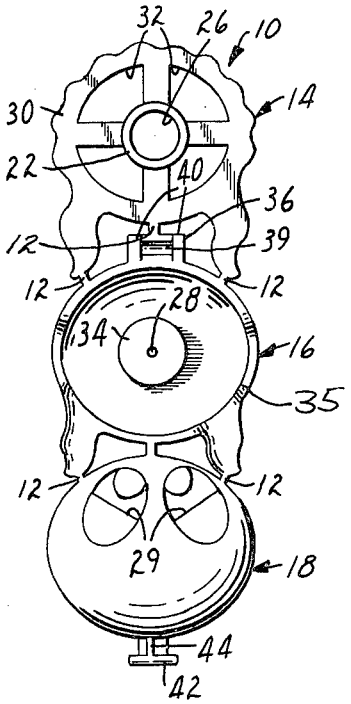
FIG. 1 is a plan view of a toy according to the present invention in an unassembled form.
Figure 4:
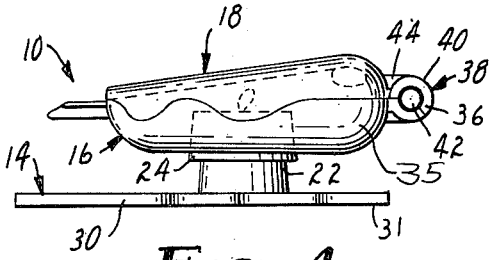
FIGS. 4, 5 and 6 are vertical views, FIGS. 5 and 6 being in section, which sequentially illustrate the operation of the assembled toy of FIG. 2.
Figure 5:
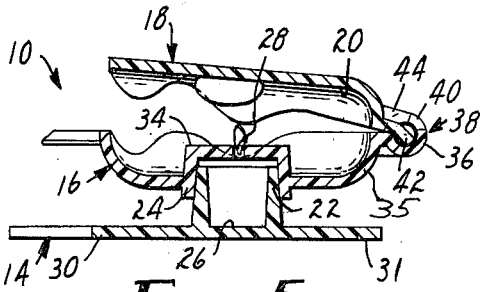

Referring now to the drawing, there is illustrated a toy 10 according to the present invention which is formed as a single molding of polymeric material. Preferably the polymeric material has a specific density of greater than 1 (e.g. polystyrene) so that the toy 10 will not float when immersed in water, although lighter polymeric materials could be used if appropriate weights were added to the toy 10. The molding can be separated (as with a scissors) at part lines 12, and then assembled to the form illustrated in FIGS. 2 through 6.

Figure 6:
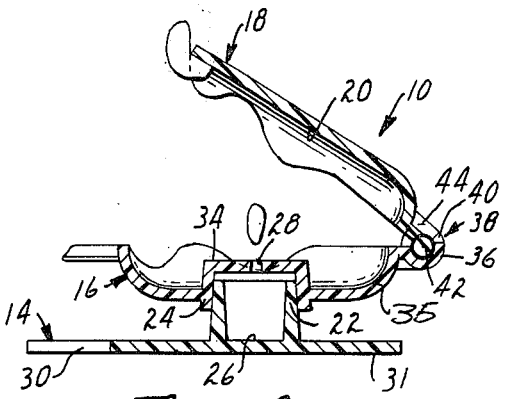

Briefly, the toy includes a base portion 14 which supports the toy 10; a central portion 16 adapted to releasably engage and be supported by the base portion 14; and a cover portion 18 with a generally concave inner surface 20 mounted on the central portion 16 for pivotal movement about an axis between a closed position (FIGS. 2, 3 and 4) and an open position (FIG. 6). Mating generally cylindrical wall parts 22 and 24 of the base and central portions 14 and 16 respectively help define a cavity 26 communicating through the cental portion 16 via an aperture 28. The cavity 26 is adapted to be packed with baking powder. The baking powder will produce gas bubbles when combined with water which will happen via water passing through the aperture 28 when the toy 10 is submersed in a vessel of water (not shown). Gas bubbles escaping through the aperture 28 will collect against the concave inner surface 20 of the cover portion 18 until the buoyancy of the gas overcomes the weight of the cover portion 18 (which weight provides means for biasing the cover portion 18 to its closed position) and the cover portion 18 moves to its open position where the gas bubbles escape allowing the cover portion 18 to again close.

When, as illustrated, the central and cover portions 16 and 18 are in the form of a creature having a clam-like head and eyes formed by raised ridges and openings 29 in the cover portion 18, the toy 10 provides the illusion of a creature opening and closing his mouth below water to release air.

The base portion 14 comprises a flat bottom plate 30 having a surface 31 on which the top 10 is supported. The plate 30 is of sufficient size to support the toy upright in the water during movement of the cover portion 18, and has four symmetrically located openings 32 to save material and to reduce resistance as the toy 10 moves to the bottom of a vessel of water. The plate 30 together with the projecting generally cylindrical wall part 22 provide a cup into which the baking powder for operating the toy may be packed (as with the tip of the finger or the end of a pencil) when the base and central portions 14 and 16 are separated.

The central portion 16 includes a generally cylindrical wall which includes the wall part 24 and ends at a circular end wall 34 in which the aperture 28 is formed. The wall part 24 has a generally cylindrical but slightly tapered inner surface which will frictionally engage the outer surface of the wall part 22 (which is also generally cylindrical but slightly tapered) to provide a generally water tight engagement therebetween so that water will enter the cavity only at the aperture 28 when the toy is submersed in water. The aperture 28 must be able to meter water into the cavity 26 while allowing escape of gas bubbles. With a cavity 26 having a height of about 0.26 inch and a diameter of about 0.28 inch for receiving baking powder, an aperture 28 having a diameter of 0.031 inch at the surface of the end wall opposite the cavity 26 and flared at 10° toward the cavity 26 has been found to produce good bubble sizes and affords continuous operation of the toy for over 20 minutes. The central portion 16 has a generally bowl shaped flange 35 around the wall part 22 which provides a lip against which the cover portion 18 rests when in its closed position.

At one edge of the flange 35 is a projecting part 36 of a hinge 38 which provides the means for pivotably mounting the cover portion 18 on the central portion 16. The part 36 of the hinge 38 on the central portion 16 includes a central trough-like segment 39 having a groove with an axis along the pivotal axis for the cover portion 18, and a ring-like member 40 at each end of the trough-like segment 39. A T-shaped part 42 of the hinge 38 which projects from one edge of the cover portion 18 has radiused ends which can be permanently positioned in the ring-like members 40 by inserting one slightly longer end in one ring-like member 40 and then using the cover portion 18 as leverage to momentarily bend the parts sufficiently to snap the second end into the other ring-like member 40.

Means are provided for limiting movement of the cover portion 18 at a position at which its weight and center of gravity will return it to a closed position after a bubble has escaped from under the concave surface 20. The cover portion 18 has a bar-like projection 44 with an end surface adapted to engage the segment 39 of the hinge part 36 and thus limit opening movement of the cover portion 18 at its open position.

The concave inner surface 20 of the cover portion 18 includes an inverted trough-like part or side 46 which is arcuately concave about an axis normal to the pivotal axis for the cover portion 18 and generally bisecting the cover portion 18. The inverted trough-like side 46 extends from the edge of the cover portion 18 opposite the hinge 38 toward the hinge 38, and has a straight bottom line (see FIG. 3). The concave inner surface 20 also includes a domed part or side 48 positioned adjacent the hinge 38 which smoothly merges with the inverted trough-like side 46 to provide a concave inner surface 20 generally in the shape of the inner surface of an inverted scoop. With the cover in its closed position (FIGS. 3 and 4), the bottom of the trough-like side 46 is inclined upwardly toward the domed side 48 so that gas bubbles escaping from the orifice 28 will move upwardly along the inverted trough-like side 46 and will be collected and combined under the domed side 48. When sufficient gas bubbles collect to overcome the weight of the cover portion 18, the buoyancy of the gas will lift the cover portion 18 (FIG. 5) and will move it to its open position (FIG. 6) at which the bottom of the inverted trough-like side 46 is inclined upwardly away from the hinge 38. The bubble then moves upwardly along the center of the inverted trough-like side 46 (which is free of obstruction to insure that the bubble can move quickly and freely) and escapes from under the surface 20 at the edge of the cover portion 18 between the eyes. The weight of the cover portion 18 then returns it to its closed position until sufficient gas bubbles are collected under the cover portion 18 to repeat the cycle.

I claim:

1. A toy for use under water comprising:

a base portion adapted to support said toy on a horizontal surface;

a central portion adapted to releasably engage and be supported by said base portion, mating parts of said base and central portions being adapted to provide a cavity therebetween and said part of said central portion having an aperture communicating through said central portion;

a cover portion having a generally concave surface; and means adapted to mount said cover portion on said base portion for pivotable movement about an axis between a closed position with said concave surface adjacent said central portion over said aperture, and an open position with said concave surface spaced further from said aperture;

said generally concave surface comprising a part which is generally trough-like about an axis which is generally normal to the axis of pivoting for said cover portion, and a domed part adjacent the axis of pivoting for said cover portion which domed part smoothly joins the trough-like part, the axis of said trough-like part being inclined upwardly toward said domed part when said cover portion is in said closed position and being inclined upwardly away from said domed part when said cover portion is in said open position so that, with the assembled toy submerged in water with said base supported on a horizontal suface, gas bubbles produced by the combination of water and chemicals in said cavity will move through said aperture along said trough-like part and will be retained under the domed part of said concave surface until the buoyancy of the gas moves said cover portion to said open position at which the gas will move along said trough-like part and be released from under said cover portion.

2. A toy according to claim 1, wherein the mating parts of said base and central portions are adapted for telescoping frictional engagement.

3. A toy according to claim 1, wherein said base portion, central portion and cover portion are a separable one piece molding of polymeric material having a specific density of greater than 1.

4. A toy according to claim 1, wherein said base portion, central portion and cover portion are a separable one piece molding of polystyrene.

5. A toy for use under water comprising:

a base portion adapted to support said toy on a horizontal surface;

a central portion releasably engaging and being supported by said base portion, mating parts of said base and central portions providing a cavity therebetween and said part of said central portion having a through aperture communicating with said cavity;

a cover portion having a generally concave surface; and means mounting said cover portion on said base portion for pivotal movement about an axis between a closed position with said concave surface positioned adjacent said central portion and over said aperture, and an open position with said concave surface spaced further from said aperture;

said generally concave surface comprising a part which is generally trough-like about an axis which is generally normal to the axis of pivoting for said cover portion and a domed part adjacent the axis of pivoting for said cover portion which domed part smoothly joins the trough-like part, the axis of said trough-like part being inclined upwardly toward said domed part when said cover portion is in said closed position and being inclined upwardly away from said domed part when said cover portion is in said open position so that, with said base supported on a horizontal surface, gas bubbles produced by the combination of water and chemicals in said cavity will move through said aperture along said trough-like part and be retained under the domed part of said concave surface until the buoyancy of the gas moves said cover portion to said open position at which the gas will move along said trough-like part and be released from under said cover portion.

6. A toy according to claim 5, wherein the mating parts of said base portion and central portion are in telescoping frictional engagement.

7. A toy according to claim 5, wherein said cover portion and central portion include cooperating stop means adapted to limit movement of said cover portion at said open position with the center of gravity of said cover portion positioned to bias said cover portion toward said closed position.

8. A toy according to claim 1 wherein the trough-like part of said concave surface is generally cylindrically concave about is axis.

9. A toy according to claim 5 wherein the trough-like part of said concave surface is generally cylindrically concave about its axis.

* * * * *